US008784168B2

(12) United States Patent
Grandmaison

(10) Patent No.: US 8,784,168 B2
(45) Date of Patent: Jul. 22, 2014

(54) LOUVERED VENT COVER

(75) Inventor: Marc Grandmaison, Dieppe (CA)

(73) Assignee: Imperial Sheet Metal Ltd., Richibucto, NB (CA)

( * ) Notice: Subject to any disclaimer, the term of this patent is extended or adjusted under 35 U.S.C. 154(b) by 573 days.

(21) Appl. No.: 12/818,650

(22) Filed: Jun. 18, 2010

(65) Prior Publication Data

US 2011/0312263 A1 Dec. 22, 2011

(51) Int. Cl.

| | |
|---|---|
| ***F24F 13/20*** | (2006.01) |
| ***F24F 13/08*** | (2006.01) |
| ***F24F 13/02*** | (2006.01) |
| *F24F 7/00* | (2006.01) |

(52) U.S. Cl.

CPC ..... *F24F 13/20* (2013.01); *F24F 13/084* (2013.01); *F24F 13/0254* (2013.01); *F24F 2007/001* (2013.01)

USPC ..... 454/283; 454/358; 454/367

(58) Field of Classification Search

CPC F24F 13/084; F24F 13/0254; F24F 2007/001

USPC ..... 454/283, 331, 276, 277, 358, 367; 49/463, 465

See application file for complete search history.

(56) References Cited

U.S. PATENT DOCUMENTS

| | | | | | |
|---|---|---|---|---|---|
| 3,541,945 | A | * | 11/1970 | Wexler | 454/359 |
| 4,338,731 | A | * | 7/1982 | Shames et al. | 34/82 |
| 4,967,490 | A | * | 11/1990 | Berger et al. | 34/235 |
| 5,280,135 | A | * | 1/1994 | Berlin et al. | 174/67 |
| 5,365,707 | A | * | 11/1994 | Jones et al. | 52/211 |
| 5,482,507 | A | | 1/1996 | Priest | |
| 5,586,933 | A | * | 12/1996 | Sawyer et al. | 454/299 |
| 5,722,181 | A | * | 3/1998 | Meyer | 34/235 |
| D395,283 | S | * | 6/1998 | Monaco et al. | D13/156 |
| 5,916,023 | A | * | 6/1999 | Meyer | 454/359 |
| 6,183,360 | B1 | * | 2/2001 | Luter et al. | 454/366 |
| 6,302,788 | B1 | * | 10/2001 | Gagnon | 454/367 |
| 6,310,287 | B1 | * | 10/2001 | Schiedegger et al. | 174/50 |
| 6,361,433 | B1 | * | 3/2002 | Gray | 454/358 |
| 6,383,072 | B2 | * | 5/2002 | Schiedegger et al. | 454/339 |
| 6,394,300 | B1 | * | 5/2002 | Bosy | 220/326 |
| 6,601,356 | B2 | * | 8/2003 | Snyder | 52/302.1 |
| 6,612,924 | B1 | * | 9/2003 | Mantyla et al. | 454/367 |
| 7,108,600 | B1 | * | 9/2006 | Krzyskowski et al. | 454/332 |
| 7,140,960 | B2 | * | 11/2006 | Pilger | 454/331 |
| 7,147,554 | B1 | * | 12/2006 | Berger | 454/359 |
| 7,549,258 | B2 | * | 6/2009 | Lajewski | 52/220.8 |
| 7,780,510 | B2 | * | 8/2010 | Polston | 454/367 |
| 8,033,900 | B2 | * | 10/2011 | Vanden Bosch et al. | 454/359 |
| 2003/0082008 | A1 | * | 5/2003 | Sprengle et al. | 405/87 |
| 2003/0110554 | A1 | * | 6/2003 | Hernandez | 4/218 |

(Continued)

*Primary Examiner* — Kang Hu
*Assistant Examiner* — Anthony Kandare
(74) *Attorney, Agent, or Firm* — Pearl Cohen Zedek Latzer Baratz LLP

(57) ABSTRACT

A louvered vent cover includes a pest guard cover, a louver frame and a vent duct attachment. The pest guard cover has a grilled guard and is mounted on the louver frame by means of pins. The louver frame contains several louvers which permit one-way passage of the air to the exterior of the building. The louver frame is mounted to the vent duct attachment by means of tabs and a clip. The vent duct attachment is adapted to fit within a vent duct. The louvered cover may be mounted over a vent duct in a new construction, or, without use of the vent duct attachment, may be mounted over an existing vent duct cover.

8 Claims, 6 Drawing Sheets

(56) References Cited

U.S. PATENT DOCUMENTS

2006/0025067 A1* 2/2006 Koessler ..... 454/359
2006/0172695 A1* 8/2006 Stravitz ..... 454/358
2009/0280737 A1* 11/2009 Jacak et al. ..... 454/358
2010/0159821 A1* 6/2010 Bredahl et al. ..... 454/358
2011/0312262 A1* 12/2011 Grandmaison ..... 454/276

* cited by examiner

LOUVERED VENT COVER

FIELD OF THE INVENTION

The invention relates generally to venting and specifically to a louvered cover that fits over an external wall vent.

BACKGROUND OF THE INVENTION

Vents are required in buildings to permit air exchange with the outside for dryers, bathroom and kitchen fans, and heating and cooling, among other reasons. Vent coverings prevent outside air from entering buildings, while permitting inside waste air to be exhausted to the outside. However, such vent coverings suffer wear and tear, and in time no longer seal the outside air out as well as when they were new, and need to be replaced. However, replacing a vent covering is difficult and not available to the average homeowner because of the complexity in making a seal with the vent duct aperture, and the danger that removing the old vent covering will pull the vent duct loose within the wall. This last situation is difficult to repair because the wall needs to be entered from the interior of the house, through the drywall. Typically a professional is required which can greatly increase costs and cause delays in the repair of the vent covering, leading to environmental inefficiency in the form of air leakage in the meantime.

Previous attempts have been made in order to address this problem such as U.S. Pat. No. 4,967,490 (Berger), which has louvers and a vent hood that appear to be replaceable should they malfunction, however, it is awkward changing each individual louver, and then setting a new hood atop the replaced louvers. There is no mechanism for facilitating this replacement and it is only by bending the plastic louvers that the new louvers fit in the recesses along the edges of the side walls of the vent.

U.S. Pat. No. 5,482,507 (Priest) describes a vent structure and separate masonry guide, which fits over the vent duct aperture. The masonry guide fits generally over the vent duct aperture, and a louvered portion fits within the masonry guide. The louvered portion is replaceable if defective, however the invention does not produce a seal with the duct opening, so as to be environmentally-insulating. As well, the louvered portion is not intended to be replaceable, and the screw holes used to mount the louvered portion would wear out in short order as it is replaced.

Accordingly, there is a need for an easy to use louvered vent hood which facilitates its own replacement as well as replacement of certain parts of the vent.

SUMMARY OF THE INVENTION

Embodiments of the present invention disclose a louvered cover including a pest guard cover, a louver frame and a vent duct attachment. The pest guard cover has a grilled guard and is removably mounted on the louver frame by means of pins projecting from the sides of the louver frame. The louver frame contains several louvers which permit one-way passage of the air to the exterior of the building, and are pivotally mounted within the louver frame so as to overlap with each other, and such that they may be pushed open by changes in air pressure between the interior and exterior of the building.

The louver frame is mounted to the vent duct attachment by means of tabs and a clip on the vent duct attachment, which clip positively engages a corresponding aperture on the rear of the louver frame. The vent duct attachment is adapted to fit within a vent duct. The louvered cover may be mounted over a vent duct in a new construction, using securing apertures, and thereby sealed to the exterior wall over the vent duct or, without use of the vent duct attachment, may be mounted over an existing vent duct cover, once the old louvers are removed.

In one embodiment a louvered vent cover for mounting over an existing vent duct aperture on a building wall includes a louver frame having one or more louvers for restricting airflow from entering the building wall, and one or more securing apertures for securing the louver frame over an existing vent duct aperture using securing means; and a grilled guard having perforations therethrough, wherein the grilled guard is attached to the louver frame. The vent duct aperture may include a pipe, and the vent cover may include a vent duct attachment, having a front and a rear face, the rear face of which has a pipe mount adapted to fit around and sealingly connect with the pipe, the front face of which has fastening means for removably connecting the vent duct attachment with the louver frame. The vent duct attachment may include pipe mount clips adapted to engage the pipe. The fastening means may include an upper clip projecting from the front face of the vent duct attachment, having a hook; one or more lower tabs projecting from the front face of the vent duct attachment. The louver frame may include pins projecting therefrom, and the grill guard may have one or more pin holes to the pins, and the grilled guard may be attached to the louver frame by each pin being positioned within each corresponding pin hole. The louver frame may be rectangular in shape. The louvers may include pivot members extending from each side of the louver. The louver frame may include slots. The louvers may be pivotally engaged with the louver frame by pivot members being inserted within the corresponding slots. Each louver slot may be horizontal, and each pivot member may include support tabs to prevent removal of the pivot members from the slots while the louver is in a position other than horizontal. The louver frame may have one or more stops to limit the pivotal range of the louvers. The louver frame may have three louvers, and three slots within the louver frame.

BRIEF DESCRIPTION OF THE DRAWINGS

It will now be convenient to describe the invention with particular reference to one embodiment of the present invention. It will be appreciated that the diagrams relate to one embodiment of the present invention only and are not to be taken as limiting the invention.

DETAILED DESCRIPTION

The present invention will now be described more fully hereinafter with reference to the accompanying drawings, in which preferred and other embodiments of the invention are shown. No embodiment described below limits any claimed invention and any claimed invention may cover processes or apparatuses that are not described below. The claimed inventions are not limited to apparatuses or processes having all the features of any one apparatus or process described below or to features common to multiple or all of the apparatuses described below. It is possible that an apparatus or process described below is not an embodiment of any claimed invention. The applicants, inventors or owners reserve all rights that they may have in any invention claimed in this document, for example the right to claim such an invention in a continuing application and do not intend to abandon, disclaim or dedicate to the public any such invention by its disclosure in this document.

Figures 1A, 1B:
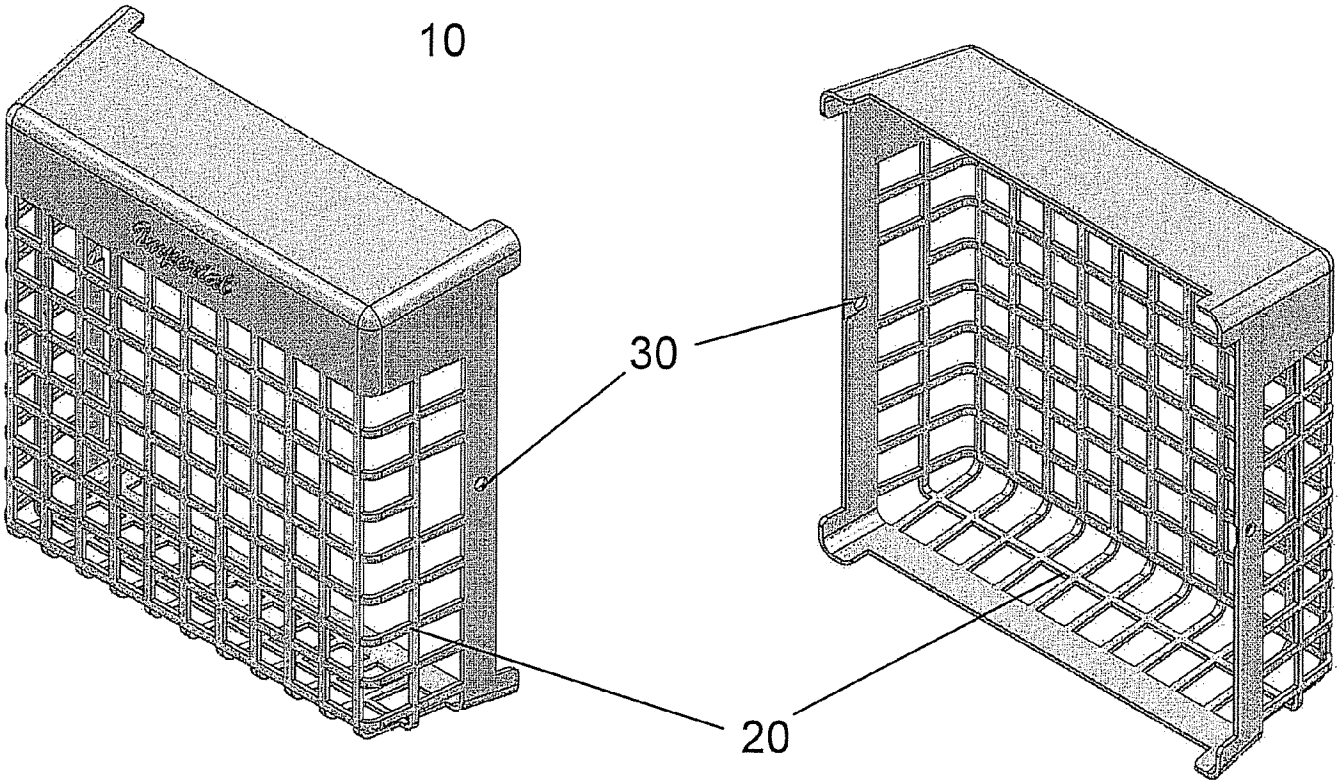
FIGS. 1*a* and 1*b* are front and back perspective views of the pest guard cover of the louvered vent cover, according to one embodiment of the present invention.

With reference to FIGS. 1*a* and 1*b*, and according to one embodiment of the present invention, the pest guard portion of the louvered cover 10 is shown having a grilled guard 20 which allows for air to exit through the guard 20 and prevent small animals and insects from entering a vent emanating from the exterior wall of a building. The guard 20 also has pin holes 30 which allow for it to be installed onto the louver frame (not shown) described with reference to FIGS. 2*a* and 2*b* below.

Figure 2B:
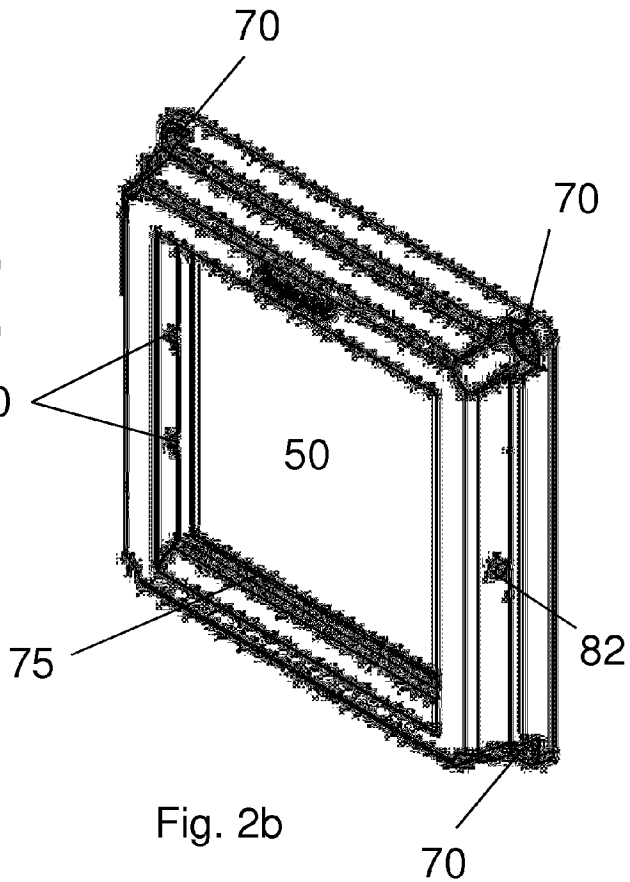
FIGS. 2*a* and 2*b* are front and back perspective views of the louver frame of the louvered vent cover, according to one embodiment of the present invention.
Figure 2A:
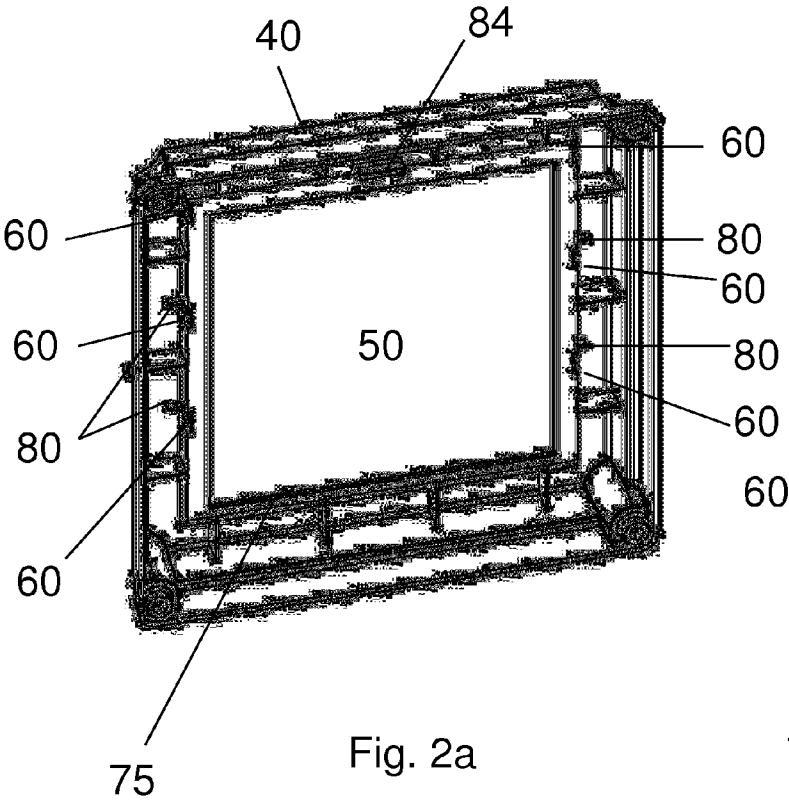

With reference to FIGS. 2*a* and 2*b*, the louver frame 40 of the present invention is shown. The louver frame 40 is generally square in shape and has a square opening 50 for the location of louvers (not shown) which can be installed in slots 60. The louver frame 40 has four securing apertures 70 in order to secure the frame to an outer wall of a building, using screws or other securing means. The slots 60 have louver stops 80 which prevent the louvers 60 from being opened to a position greater than 90 degrees relative to the louver frame 40. These louver stops 80 allow for the louvers (not shown) to be in a perpendicular relationship with the louver frame 40 when fully deployed by air exiting the building having a louvered vent cover of the present invention, and in an almost parallel relationship with the louver frame 40 when there is no air flow through the opening 50. The louver frame 40 also has opposed pins (only one shown, pin 82) in order to install the guard 10 onto the louver frame 40. With further reference to FIG. 2*a*, a receiving end 84 is positioned at the top end of louver frame 40 in order to secure an upper clip present on the vent duct attachment shown in FIGS. 5*a* and 5*b*. The opening 50 of the louver frame 40 also has a lip 75 which is utilized to secure tabs present on the vent duct attachment shown in FIG. 5*a* and 5*a*. One skilled in the art would appreciate that the louver frame 40 and accompanying opening 50 may be a different shape in order to accommodate duct openings of various shapes.

Figure 3:
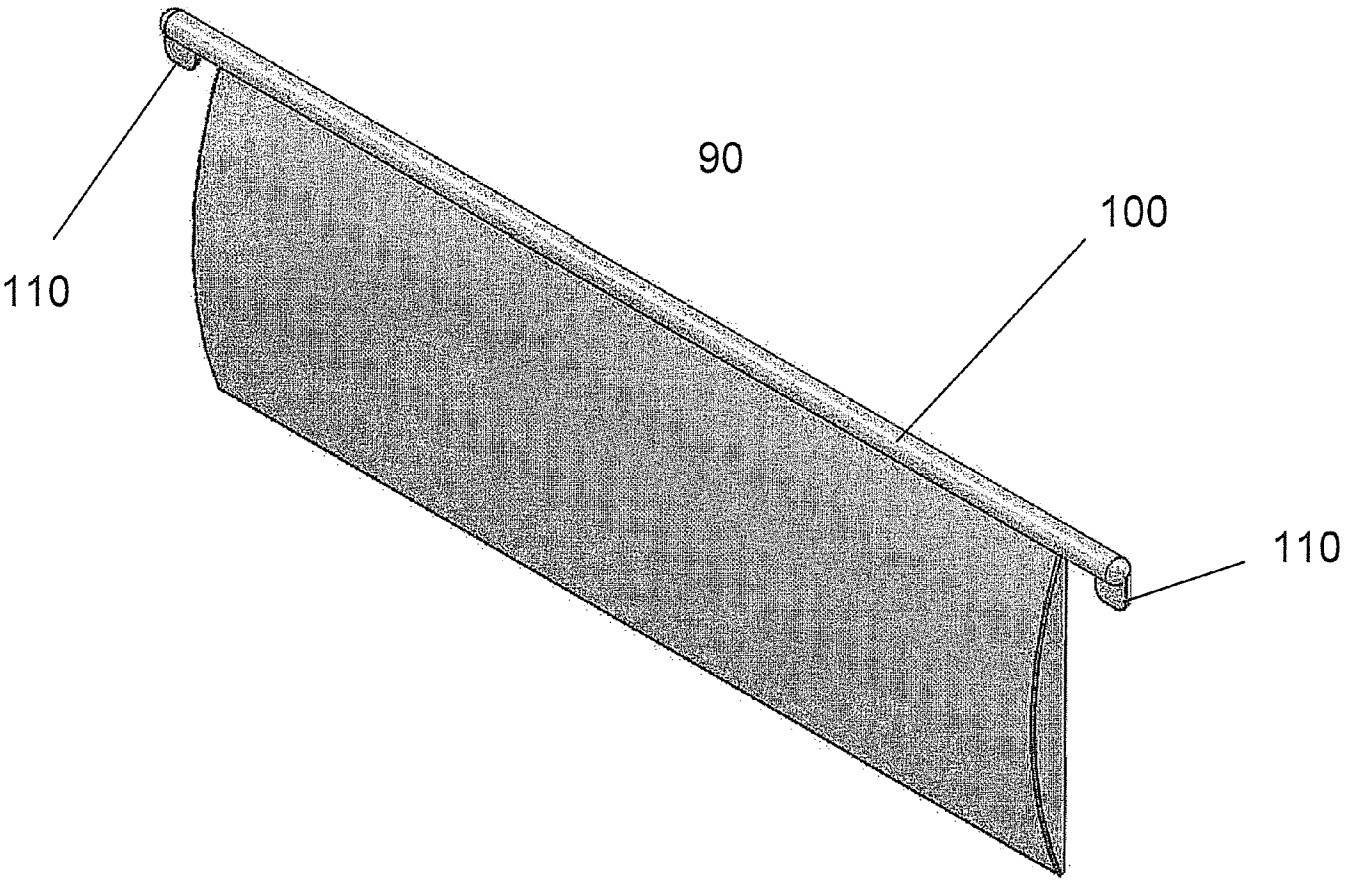
FIG. 3 is a perspective view of a louver as found fitted within the louver frame of the louvered vent cover, according to one embodiment of the present invention.

With reference to FIG. 3, a louver 90 of the present invention is shown having a pivot member 100 and support tabs 110 located at opposite ends of the pivot member 100. These support tabs 110 are positioned within the slots 60 (as shown in FIGS. 2*a* and 2*b*) and allow for a louver 90 to either pivot away from the louver frame 40 or simply rest on the louver frame 40 when no air is being expelled from the louvered vent cover of the present invention.

Figure 4:
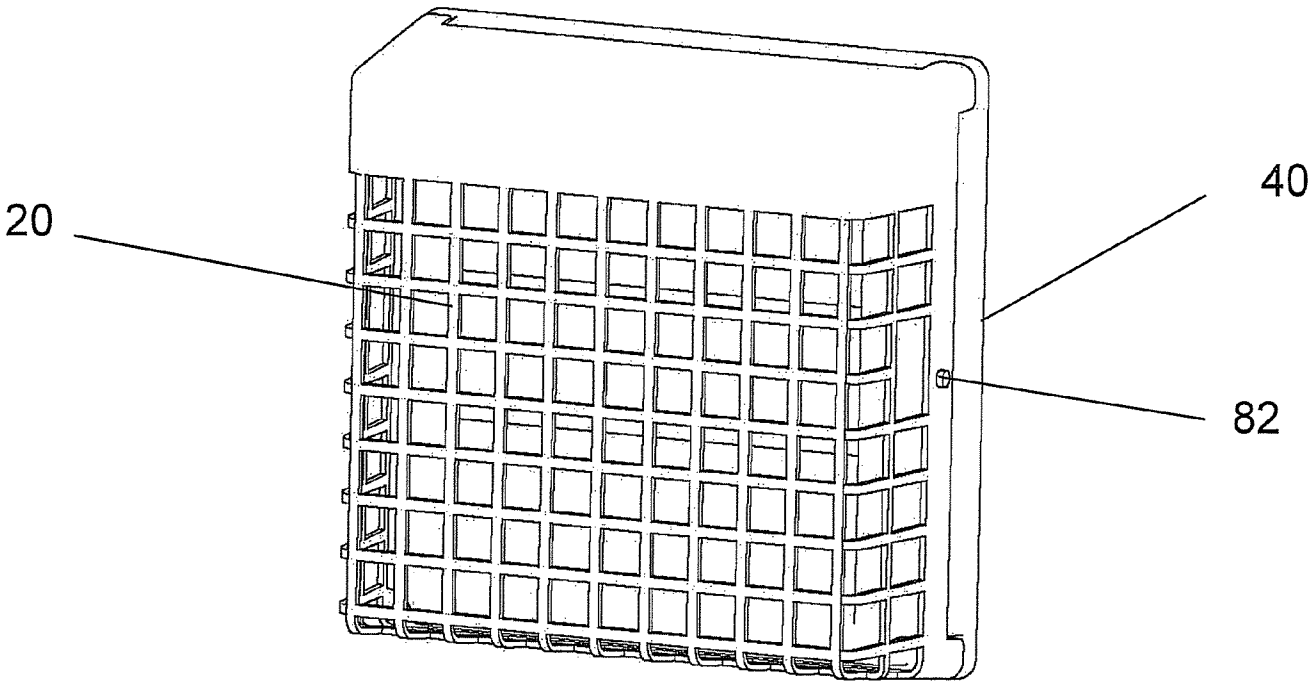
FIG. 4 is a perspective view of the pest guard shown installed on the louver frame, according to one embodiment of the present invention.

With reference to FIG. 4, the guard 20 is installed on the louver frame 40 by positioning pin 85 through the pin hole 30 (only one is shown however a corresponding pin/hole combination is located on the opposite side).

Figure 5B:
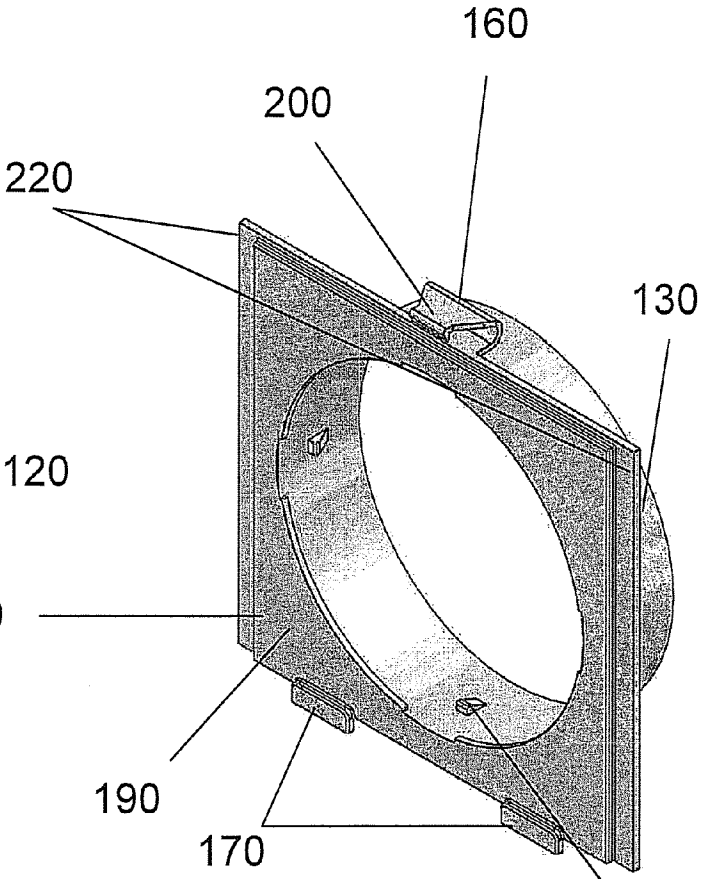
FIGS. 5*a* and 5*b* are front and back perspective views of the vent duct attachment, according to one embodiment of the present invention.
Figure 5A:
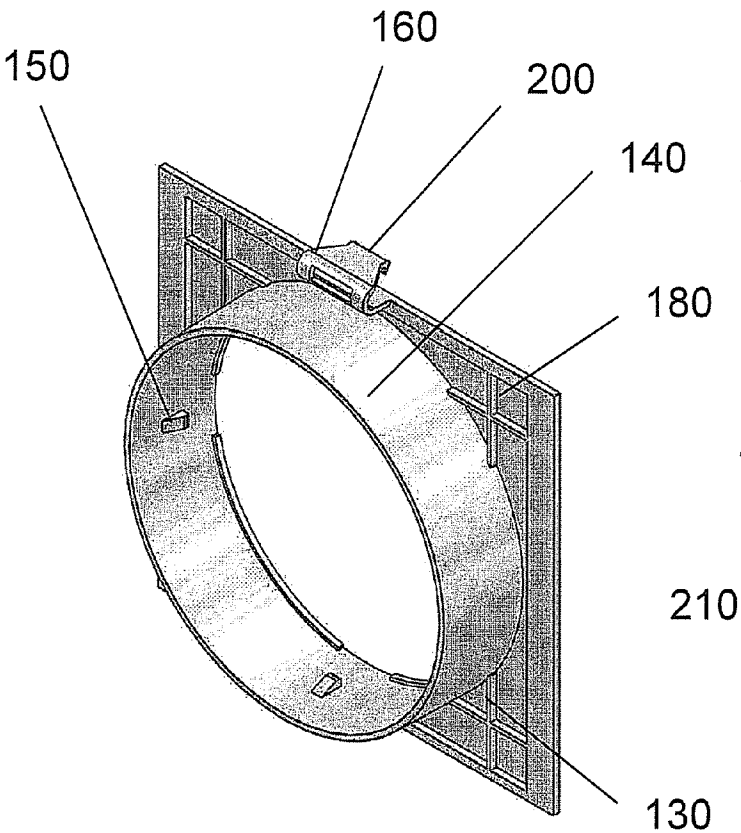

With reference to FIG. 5*a* and according to one embodiment of the present invention, a rear view of the vent duct attachment 120 is shown. The vent duct attachment 120 consists of a frame 130, a pipe mount 140, pipe mount clips 150, and an upper clip 160. The pipe mount 140 fits around the vent duct aperture (not shown), and the pipe mount clips 150 provide resistance to removal from the vent duct aperture (not shown) by pushing against it. The pipe mount 140 is such a diameter that it creates a tight fit with the vent duct aperture (not shown) and does not permit air leakage.

With further reference to FIG. 5*b* and according to one embodiment of the present invention, a front view of the vent duct attachment 120 is shown, which shows the upper clip 160, as well as lower tabs 170. The upper clip 160 and lower tabs 170 are intended to be used for replaceable attachment of the louver frame 40 cover and the vent duct attachment, and together form a fastening means to fasten the vent duct attachment to the louver frame 40. The upper clip 160 is an extension from the top rear 180 of the vent duct attachment 120 which doubles back to project from above the front 190 of the vent duct attachment 120. It has a small hook 200 which bends under the end to positively connect with a corresponding aperture (not shown) on the rear face of the replaceable louver frame 40. The front face 210 of the vent duct attachment 120 is designed to create a seal with the replaceable louver frame 40 when it is mounted. In particular, it has an interface groove 220 on the perimeter of the front face 210, which facilitates the formation of a seal with the louver frame 40.

Figure 6:
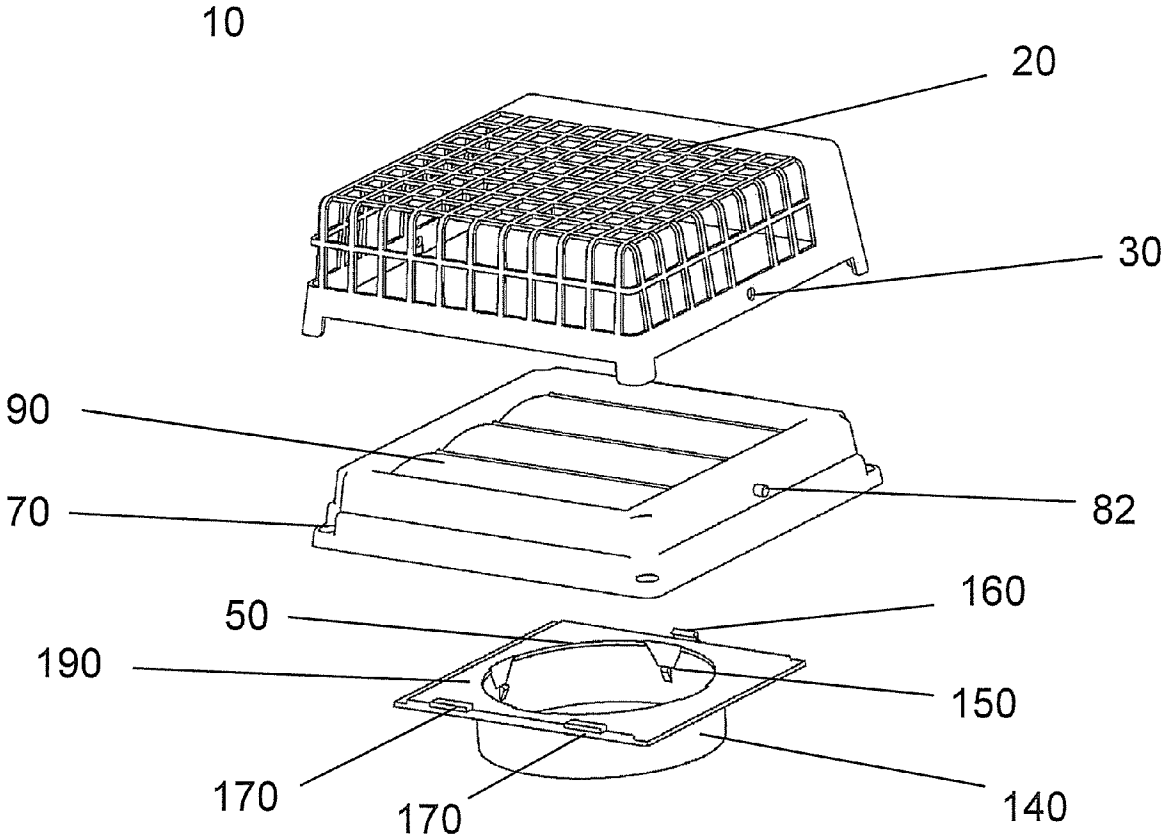
FIG. 6 is an exploded view of the three components found in the louvered vent cover, according to one embodiment of the present invention.

With reference to FIG. 6, and according to one embodiment of the present invention, an exploded view of the replaceable louvered cover 10 is shown, which consists of a pest guard 20, a louver frame 40 and a vent duct attachment 120. The louver frame 40 is attached to the vent duct attachment 120 by means of resilient upper clip 160 interconnecting with receiving end 84 (as shown in FIG. 2*a*) and fixed lower tabs 170. The rear face (not shown) of the louver frame 40 has an aperture (not shown) for attachment with the upper clip 160, as well as a lip (not shown) for engagement to the lower tabs 170 to create a positive releasable attachment and seal between the louver frame 40 and the vent duct attachment 120.

There are two ways in which the vent hood may be used. In the first, on an installation to a new home, where no previous vent hood had been attached, the guard 20 is removed from the combination, and the vent duct attachment 120 and louver frame 40 are attached to one another as described above. The pipe mount 140 is then affixed over the vent duct (not shown) by means of the pipe mount clips 150, and some caulking or other sealing agent. Securing means such as screws are used in conjunction with the securing apertures 70 to fasten the vent duct attachment to the side of the building, after which it may be sealed to the exterior wall of the building using caulking or another sealing agent. The guard 20 is then placed over the vent duct attachment 120, where it snaps into place by means of the pins 85 and pin holes 30. The guard 20 may later be removed from louver frame 40, and replaced or cleaned. The louver frame 40 may also be replaced without the need to remove the vent duct attachment 120; it may be detached by means of disengaging upper clip 160. When a new louver frame 40 has been obtained, it is simply clipped on to the vent duct attachment 120 using the upper clip 160 and lower tabs 170.

In the second way of using the invention, a vent cover that has been previously installed may be broken or leaking air, in that the louvers or flaps are broken or the frame is cracked, and may therefore require replacement. The invention may be installed over the existing vent cover, and thereby provide the benefits of the vent cover without necessitating the removal of the old cover, which may result in disturbance of the vent ducting within the walls of the building. First, the previous louvers or flaps are removed from the vent cover. The louver frame 40 may then be fastened over the existing vent cover, with securing means such as screws used to fasten the louver frame 40 to the wall by means of the apertures 70. The louver frame 40 is designed to be larger than, and fit over any pre-existing vent cover, so it easily fits over the old vent cover and may be sealed against the wall by means of caulking for example. The vent duct attachment 120 is discarded when using the invention in this second way.

One skilled in the art would appreciate that the louvered design may be replaced by another vent covering, such as a hooded free-flow exhaust, or a clamshell exhaust, among other exhaust vent designs, without deviating from the scope of the invention.

Many modifications and other embodiments of the invention will come to the mind of a person skilled in the art having the benefit of the teachings presented in the foregoing description and associated drawings. Therefore, it is understood that the invention is not to be limited to the specific embodiment disclosed, and that modifications and embodiments are intended to be included within the scope of the appended claims.

The invention claimed is:

1. A louvered vent cover for mounting over an existing vent duct aperture on a building wall, comprising:

a) a louver frame having one or more louvers for restricting airflow from entering the building wall, and one or more securing apertures for securing the louver frame over an existing vent duct aperture using securing means;

b) a grilled guard having perforations therethrough; and c) a vent duct attachment, having a front and rear face, the rear face of which has a pipe mount adapted to fit around and sealingly connect with said pipe, the front face of which has fastening means for removably connecting the vent duct attachment with the louver frame; said fastening means further comprising:

i) an upper clip projecting from the front-face of said vent duct attachment, having a hook; and ii) one or more lower tabs projecting from the front face of said vent duct attachment and pivotally connecting the vent duct attachment and the louver frame;

wherein the grilled guard is attached to the louver frame; and wherein the louver frame further comprises a lip configured to pivotally engage with the one or more lower tabs of the vent duct attachment and a receiving end configured to receive and engage the upper clip of the vent duct attachment the lip forming one or more recessions corresponding with the one or more lower tabs for engagement to the lower tabs to create a positive releasable attachment and seal between the louver frame and the vent duct attachment.

2. The vent cover of claim 1, said vent duct attachment further comprising pipe mount clips adapted to engage the pipe.

3. The vent cover according to claim 1 wherein the louver frame has one or more pins projecting therefrom, and the grill guard has one or more pin holes to said pins, and the grilled guard is attached to the louver frame by means of each pin being positioned within each corresponding pin hole.

4. The vent cover according to claim 1 wherein the louver frame is rectangular in shape.

5. The vent cover according to claim 1 wherein the one or more louvers each further comprise pivot members extending from each side of the louver, the louver frame further comprises one or more slots, and said louvers are pivotally engaged with the louver frame by means of said pivot members being inserted within the corresponding slots.

6. The vent cover according to claim 5 wherein each louver slot is horizontal, and each pivot member further comprises support tabs to prevent removal of the pivot members from the slots while the louver is in a position other than horizontal.

7. The vent cover according to claim 5 wherein the louver frame has one or more stops to limit the pivotal range of the louvers.

8. The vent cover according to claim 1 wherein the louver frame has three louvers, and three slots within said louver frame.

* * * * *